US005886430A

United States Patent [19]

Ralson et al.

[11] Patent Number: 5,886,430

[45] Date of Patent: Mar. 23, 1999

[54] REFRIGERATOR ICE DOOR DELAY CIRCUIT

[75] Inventors: James M. Ralson, Naperville; Gregory Jay Ramsey, Barrington, both of Ill.

[73] Assignee: Gabriel, Inc., Elgin, Ill.

[21] Appl. No.: 826,142

[22] Filed: Mar. 27, 1997

[51] Int. Cl.[6] ..... H01H 35/00

[52] U.S. Cl. ..... 307/126; 307/112; 307/139; 307/132 EA; 62/133; 62/344

[58] Field of Search ..... 307/112, 113, 307/125, 126, 127, 138, 139, 140, 141, 141.4, 132 R, 132 E, 132 EA; 62/133, 344; 221/150 R

[56] References Cited

U.S. PATENT DOCUMENTS

| | | | |
|---|---|---|---|
| 4,680,943 | 7/1987 | Mawby et al. | 62/300 |
| 4,739,233 | 4/1988 | Marcade | 318/474 |
| 4,942,979 | 7/1990 | Linstromberg et al. | 221/75 |
| 5,671,606 | 9/1997 | Schroeder et al. | 62/137 |

*Primary Examiner*—Jeffrey Gaffin
*Assistant Examiner*—Jonathan S. Kaplan
*Attorney, Agent, or Firm*—Trexler, Bushnell, Giangiorgi & Blackstone, Ltd.

[57] ABSTRACT

Disclosed is an electronics device for use with a refrigerator/freezer for controlling the dispensing of ice cubes by an ice auger through a door flap when a cradle is pressed. The electronics device comprises a solenoid in operative connection with the door flap, and the solenoid is powerably connectable to a 120 Volt AC line power source. The electronics device also comprises a relay switch controlled by two NPN bipolar transistors in a Darlington configuration which are in parallel connection with a diode and a capacitor. The relay switch is also connected to the power source and connects the power source to the solenoid when the cradle is pressed causing the door flap to open. The power source powers the ice auger to dispense ice cubes through the door flap, and the capacitor causes the transistors to be biased on while the capacitor is charged to a voltage greater than a voltage of the diode. When the cradle is pressed, the capacitor begins to de-charge and when the capacitor de-charges to a voltage less than the voltage of the diode, the relay switch disconnects the power source from the solenoid causing the door flap to close.

32 Claims, 4 Drawing Sheets

REFRIGERATOR ICE DOOR DELAY CIRCUIT

BACKGROUND OF THE INVENTION

The present invention relates generally to electronic devices for use with a refrigerator/freezer for dispensing ice cubes, and relates more specifically to an electronic device for use with a refrigerator/freezer for dispensing ice cubes where a power source is disconnected from a solenoid.

A common kitchen appliance is a refrigerator/freezer, and a common design for a refrigerator/freezer is one having side-by-side doors where a door on the right leads to a refrigerator, and a door on the left leads to a freezer. A premium refrigerator/freezer appliance of this type is one which includes both a water and ice cube dispenser. Usually, the water and ice cube dispenser is located on one of the doors, and is oftentimes on the left hand, or freezer-side, door. A typical water and ice cube dispenser used on a refrigerator/freezer is a dispenser which includes two cradles, one cradle for water and another for ice. In operation, when the cradle for ice is pressed, such as by a glass held by a person, a switch is engaged causing a solenoid to turn on. When the solenoid turns on, a door flap is opened, and an ice auger moves ice cubes along an ice chute, out the door flap, and into the glass. If delay circuitry were not provided in connection with the ice cube dispenser, when the glass is removed from the cradle (after the desired number of ice cubes have been received), the ice auger would instantly stop moving the ice cubes along the ice chute and the door flap would instantly close. Unfortunately, this instantaneous de-activation of the ice auger and closing of the door flap when the glass is removed from the cradle would often result in one or more ice cubes becoming stuck in the door flap, thus keeping the door flap propped open. Because the door flap essentially leads to the freezer, this propping open of the door flap may, if gone undetected for a long period of time, result in a large amount of cold air escaping from the freezer. This inevitably results in larger electric bills since more energy is needed to keep the freezer adequately cool. In more extreme situations, frost can build up in the freezer or general malfunctioning of the freezer may occur.

As a result, delay circuitry is often provided in connection with an ice cube dispenser. The delay circuitry operates to keep the door flap open for a period of time after the glass is removed from the cradle. In this manner, the final couple of ice cubes being moved along the ice chute by the ice auger are allowed to drop through the door flap, and no ice cubes become stuck in the door flap when the glass is removed from the cradle.

Prior art delay circuitry has comprised, for example, a charged capacitor connected to a Field Effect Transistor (FET), and the FET is connected to a solenoid. When a glass is removed from the cradle, the charged capacitor keeps the FET conducting until the capacitor runs out of energy. This arrangement has provided that the solenoid keeps the door flap open for a period of time after the glass is removed from the cradle. Unfortunately, this design provides that the FET is connected at all times to a power source, such as to a 120 Volt AC power line. As a result, a major electrical disturbance in the power line can cause the FET to fail, and cause the voltage to "punch through" the FET onto to the solenoid. Thereafter, the solenoid would remain powered whether or not the cradle is pressed. In fact, the solenoid would remain powered until the appliance were unplugged or until the solenoid overheats. Overheating of the solenoid can not only result in the freezer contents becoming ruined, but can result in material surrounding the solenoid, such as a plastic enclosure, melting and the dispenser generally being destroyed.

Therefore, prior art delay circuitry has solved some of the problems mentioned hereinabove, but some problems are still encountered. The present invention is directed to substantially eliminate the problems encountered heretofore.

OBJECTS AND SUMMARY OF THE INVENTION

A general object satisfied by the claimed invention may be to provide electronics which disconnects a power source from a solenoid.

Another object satisfied by the claimed invention may be to provide electronics including a relay switch which disconnects a power source from a solenoid after a switch is returned to a first position and after a delay period has expired.

A more specific object satisfied by the claimed invention may be to provide an electronics device for use with a refrigerator/freezer for controlling the dispensing of ice cubes by an ice auger through a door flap when a cradle is pressed where the electronics device includes a relay switch which disconnects a power source from solenoid, thus causing the door flap to close, after the cradle is released and a delay time has expired.

Briefly, and in accordance with the foregoing, the present invention envisions electronics for disconnecting a power source from a solenoid where the solenoid is in operable connection with a movable structural body. In accordance with the present invention, the electronics comprises a relay switch connected to the solenoid and to the power source, and the relay switch causes the power source to connect with and power the solenoid to move the structural body when a switch is switched from a first position to a second position. The relay switch disconnects the power source from the solenoid after the switch is returned to the first position.

More specifically, the present invention envisions an electronics device for controlling the dispensing of ice cubes through a door when a switch is actuated. In accordance with the present invention, the electronics device comprises a solenoid in operative connection with the door and connected to a power source. The electronics device also comprises a relay switch connected to the solenoid. The relay switch connects the power source to the solenoid when the switch is actuated causing the solenoid to open the door, and ice cubes are dispensed through the door. The relay switch disconnects the power source from the solenoid after the switch is de-actuated.

A preferred embodiment of the present invention envisions an electronics device for use with a refrigerator/freezer for controlling the dispensing of ice cubes by an ice auger through a door flap when a cradle is pressed. In accordance with the present invention, the electronics device comprises a solenoid and a relay switch. The solenoid is in operative connection with the door flap and is connectable to a 120 Volt AC line power source. The power source is also connected to the ice auger. The relay switch is controlled by two NPN bipolar transistors in a Darlington configuration which are in parallel connection with a diode and a capacitor. The relay switch is also connected to the power source and connects the power source to the solenoid when the cradle is pressed causing the solenoid to open the door flap. The power source powers the ice auger to dispense ice cubes through the door flap. The capacitor causes the transistors to be biased on while the capacitor is charged to a voltage greater than a voltage of the diode. After the cradle is released and after the capacitor de-charges to a voltage less than the voltage of the diode, the relay switch disconnects the power source from the solenoid causing the door flap to close.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DETAILED DESCRIPTION OF A PREFERRED EMBODIMENT

Figure 1:
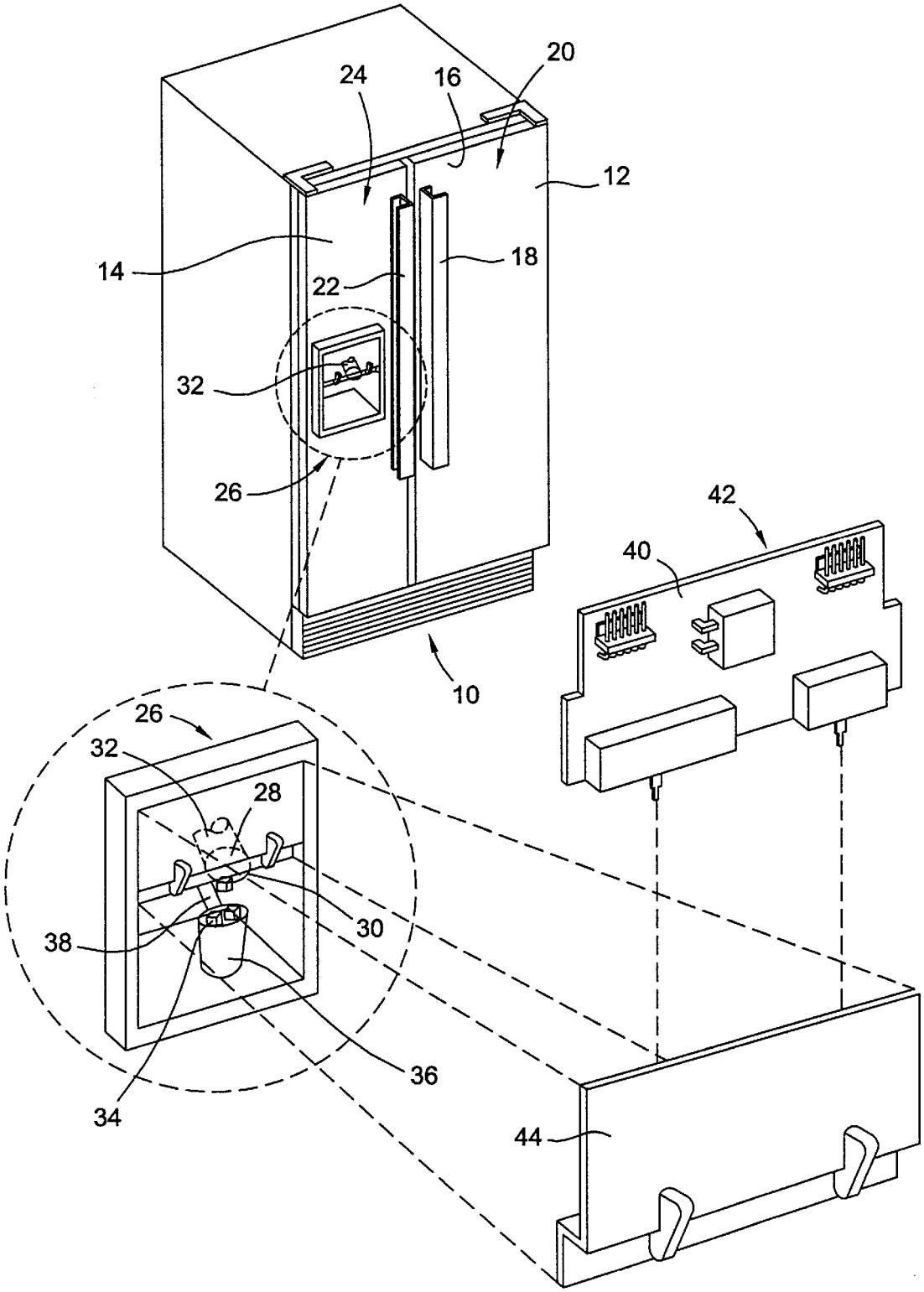
FIG. 1 is a schematic diagram showing how electronics in accordance with the present invention is incorporated into a door of a common refrigerator/freezer appliance.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

FIG. 1 shows a typical refrigerator/freezer appliance 10 having a right hand door 12 and a left hand door 14 on the front 16 of the refrigerator/freezer appliance 10. On the right hand door 12 is a handle 18 for providing access into a refrigerator section 20 of the refrigerator/freezer appliance 10. Likewise, on the left hand door 14 is ahandle 22 for providing access into a freezer section 24 of the refrigerator/freezer appliance 10. Of course, the refrigerator section 20 can be provided on the left, and the freezer section 24 can be provided on the right, but this is not the configuration of most refrigerator/freezer appliances readily available on the market. As shown in the FIG. 1, an ice cube dispenser assembly 26 can be mounted on one of the doors 12 or 14 of the refrigerator/freezer appliance 10; for example, as shown, the ice cube dispenser assembly 26 can be mounted on the left hand door 14 of the refrigerator/freezer appliance 10. Alternatively, a combination water and ice cube dispenser assembly (not shown) can be mounted on one of the doors 12 or 14 of the refrigerator/freezer appliance 10. An ice cube dispenser assembly 26 provided without the water dispenser is depicted and described herein merely for simplicity since the present invention is envisioned to relate more specifically to an ice cube dispenser. However, one skilled in the art would realize that the present invention may not be limited thereto, and one is directed to turn to the claims to determine the scope of the present invention.

As shown in FIG. 1, the ice cube dispenser assembly 26 may include a door flap 28 at an end 30 of an ice chute 32 within the freezer section 24 of the refrigerator/freezer appliance 10 for releasing ice cubes 34 therethrough into a glass 36 when the glass 36 is pressed against a cradle 38. One skilled in the art would realize that providing a cradle 30 such as that which is depicted and described herein is not imperative, and that some other means for directing the ice cube dispenser assembly 26 to dispense ice cubes 34 may be provided. For example, an infrared eye (not shown) may be provided which automatically and "invisibly" detects the presence of a glass 36, or a simple button may be provided for a user to push with his or her finger. One skilled in the art would inevitably realize still more methods and/or structures for directing the ice cube dispenser assembly 26 to dispense ice cubes 34.

Shown is electronics 40 in accordance with the present invention configured on a board 42. As shown, the board 42 may be integrated with the ice cube dispenser assembly 26 and a cover 44 may be situated over the board 42 in order to hide the board 42 from view.

Figure 2:
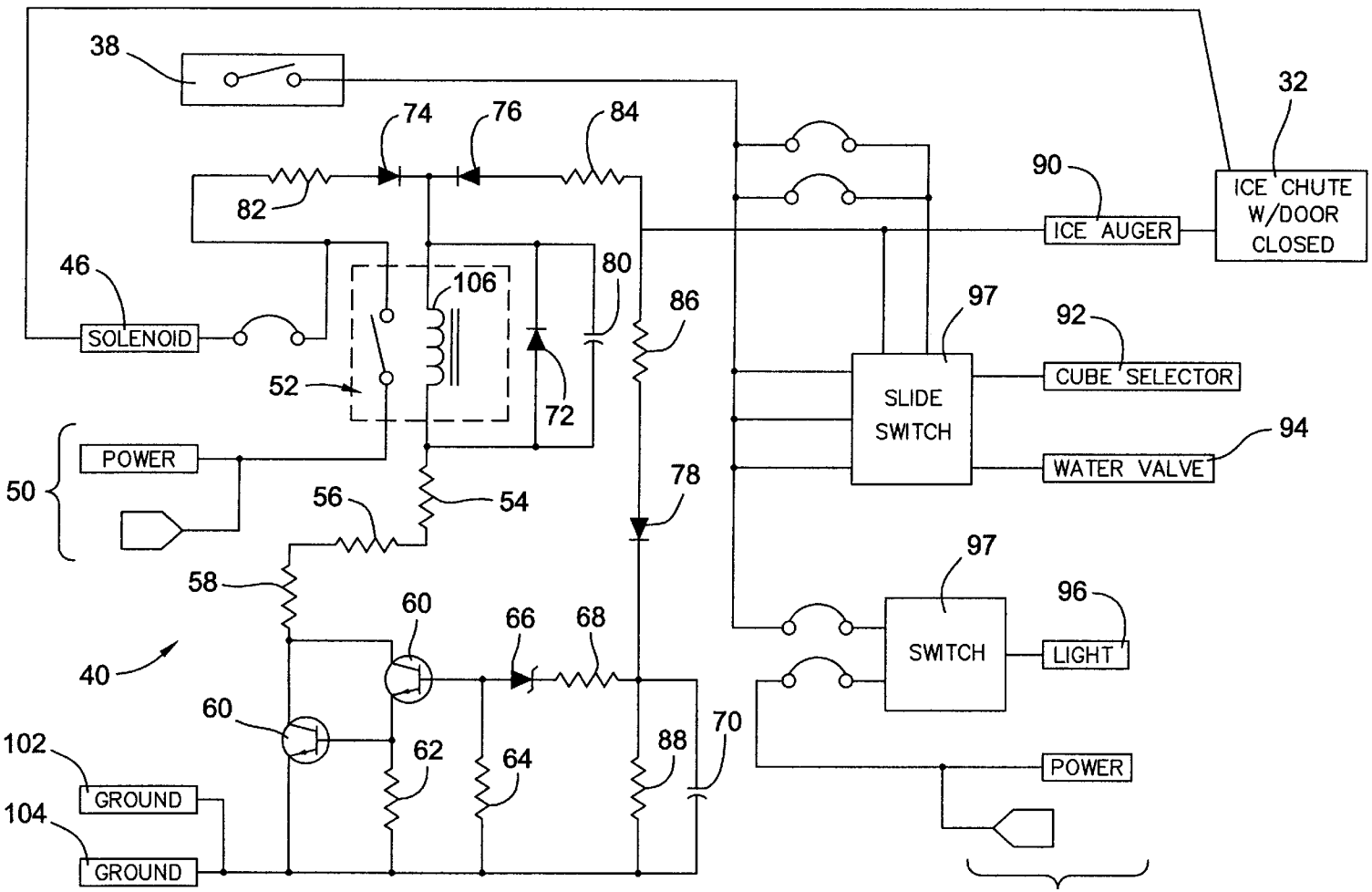
FIG. 2 is a circuit diagram of the electronics shown in FIG. 1 illustrating a relay switch in an open position.

FIG. 2 is a circuit diagram showing more specifically the electronics 40 in accordance with the present invention and showing the connections which result from integrating the board 42 with the ice cube dispenser assembly 26 as shown in FIG. 1. As shown in FIG. 2, the electronics 40 include a solenoid 46 in operative connection with the door flap 28. The solenoid 46 is also connectable to a power source 50, such as to a 120 Volt AC line, through the closing of a relay switch 52. As shown, the relay switch 52 is connected to three resistors 54, 56 and 58 in series, and to two NPN bipolar transistors 60 in a Darlington configuration. The transistors 60 are connected to resistors 62 and 64, to a Zener diode 66, to another resistor 68 and to a capacitor 70. Other relevant elements of the electronics 40 include diodes 72, 74, 76 and 78, capacitor 80, and resistors 82, 84, 86 and 88, all connected as shown.

As shown, the electronics 40 may be connected to an ice auger 90, to a cube selector 92, to a second solenoid (not shown) which operates ice crusher blades (not shown) within the freezer section 24 of the refrigerator/freezer appliance 10, to a water valve 94 within the freezer section 24 of the refrigerator/freezer appliance 10, and to an ice dispenser light 96 which may be on the left hand door 14 of the refrigerator/freezer appliance 10. Additionally, the electronics 40 may include switches 97, as shown, in order for the electronics 40 to facilitate other specific, desired functions. The electronics 40 may be grounded at points 102 and 104 as well as at other points not specifically shown.

Although one having ordinary skill in the art would be able to design countless alternatives to the specific circuit depicted herein while still remaining entirely within the scope of the present invention, the specific elements of the circuit will nevertheless now be disclosed merely for illustration. The functioning of this specific circuit will then be described in detail.

The resistors within the electronics 40 may be as follows: each of resistors 82 and 84 may be a 680 Ohm, 1.0 Watt resistor; each of resistors 54, 56 and 58 may be a 820 Ohm, 2.0 Watt resistor; each of resistors 64, 68 and 88 may be a 470 kilo ohm, 0.25Watt resistor; and each of resistors 62 and 86 may be a 10 kilo ohm, 0.25 Watt resistor. Capacitor 70 may be a 10 microFarrad, 200 Volt capacitor, and capacitor 80 may be a 4.7 microFarrad, 100 Volt capacitor. Diodes 72, 74 and 76 may be 1N4007 diodes, and diode 66 may be a 1N5252 Zener diode. Each of Transistors 60 may be a MPSA42NPN bipolar transistor. Finally, the relay switch 52 may include an inductor 106 which is a 48 Volt inductor.

The functioning of the electronics 40, and particularly the anticipated functioning of the relay switch 52 when the electronics 40 is utilized in connection with a refrigerator/freezer appliance 10, will now be described. When used within a refrigerator/freezer appliance 10, the electronics 40, and particularly the relay switch 52, initially appears as shown in FIG. 2. As shown, the relay switch 52 is initially open, and the door flap 28 at the end 30 of the ice chute 32 is closed. At this point in time, no power is essentially consumed by the circuit and no current is flowing therethrough.

Figure 3:
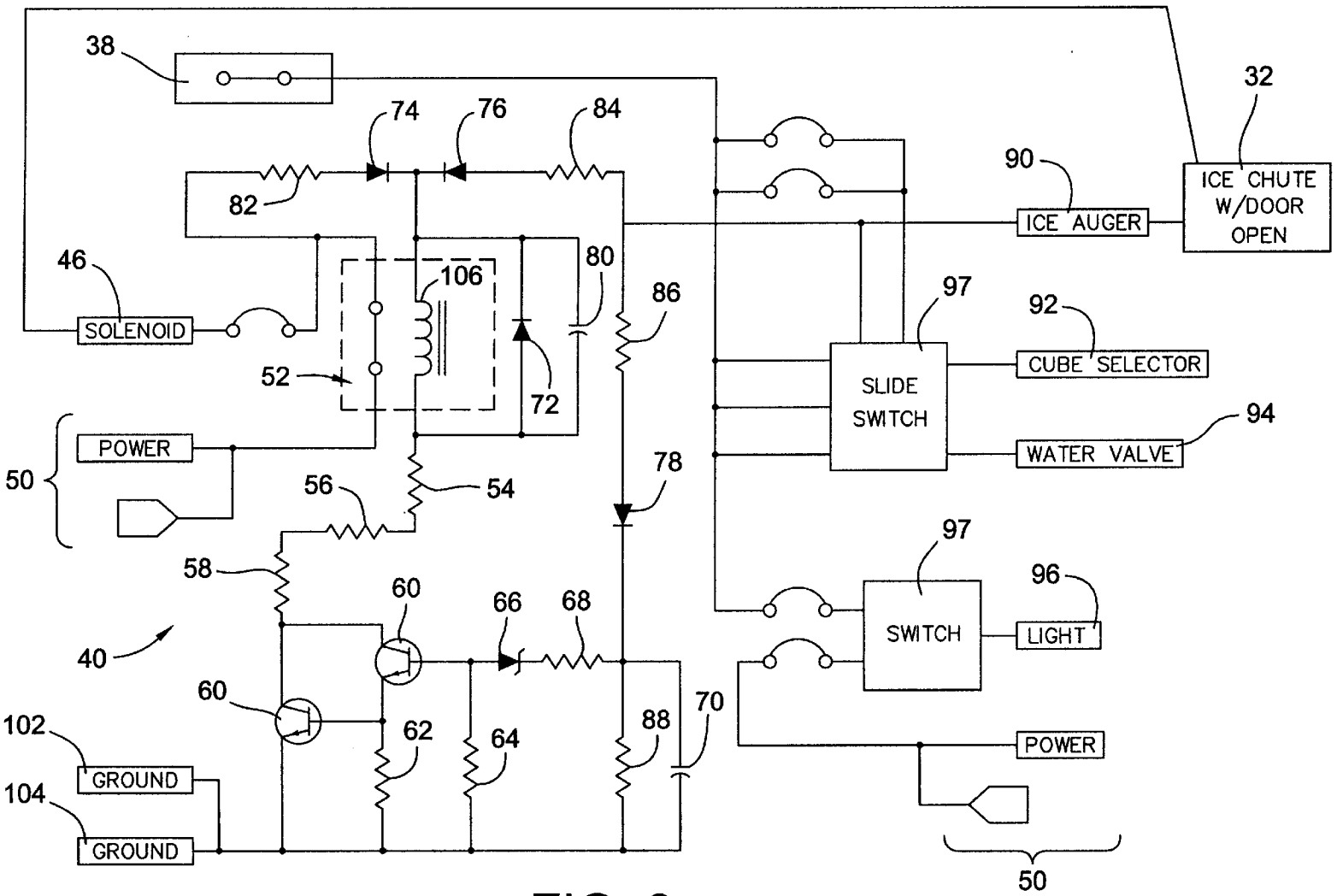
FIG. 3 is a circuit diagram of the electronics shown in FIG. 2 illustrating the closing of a relay switch after a cradle is pressed.

Subsequently, when a glass 36 is pressed against the cradle 38 of the refrigerator/freezer appliance 10 as shown in FIGS. 1 and 3, the cradle switch 38 closes, as shown in FIG. 3, and current is supplied to the circuit from the power source 50. As mentioned, power source 50 may be a 120 Volt power line. When the cradle switch 38 closes, the power source 50 powers the ice auger 90 which moves ice cubes 34 along the chute 32. Additionally, a voltage is supplied to the capacitor 70 through the diode 78 and resistor 86, and the capacitor 70 is charged to a voltage greater than a voltage of the diode 66. This charging of the capacitor 70 causes the transistors 60 to be biased on. As a result, the relay switch 52 closes, and power is supplied to the solenoid 46, which causes the door flap 28 to open. This permits the ice auger 90 to dispense ice cubes therethrough and into the glass 36. As long as the cradle 38 remains pressed, the capacitor 70 will remain fully charged to a voltage in excess of the voltage of the diode 66, the relay circuit 52 will remain closed, and power will be supplied to the relay switch 52 through resistor 82 and diode 74.

Figure 4:
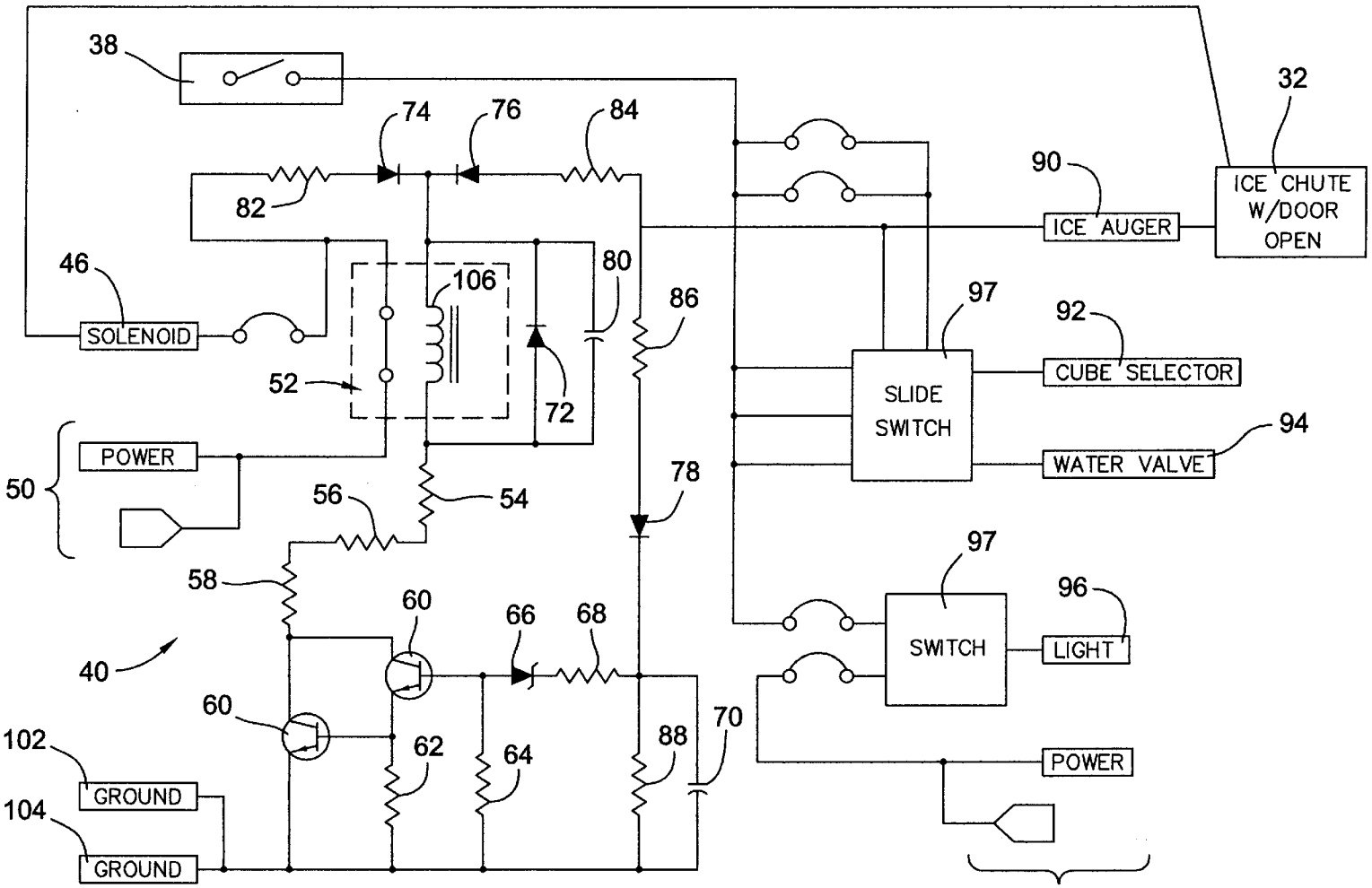
FIG. 4 is a circuit diagram of the electronics shown in FIG. 3 illustrating the relay switch remaining closed after the cradle is released but before a delay period has expired.

As shown in FIG. 4, when the glass 36 is removed from the cradle 38, the cradle switch 38 opens, voltage is maintained to the relay switch 52 through resistor 82 and diode 74, and the relay switch 52 remains closed. Because the relay switch 52 remains closed, the solenoid 46 continues to be powered by the power source 50. As a result, the door flap 26 stays open. However, when the glass 36 is removed from the cradle 38, the capacitor 70 begins to slowly de-charge through the resistors 68 and 88, the diode 66 and the base-emitter of the transistors 60. Preferably, after about four to ten seconds, the voltage across the capacitor 70 decays to a voltage below the voltage required to keep the transistors 60 biased on. This causes the relay switch 52 to open; therefore, power is no longer provided to the solenoid 46. As a result, the door flap 28 closes, and the circuit would again appear as shown in FIG. 2.

It is in this manner that the electronics 40 as described and depicted herein can be utilized in connection with a refrigerator/freezer appliance 10 to provide that a door flap 28 remains open for a period of time after a cradle 38 is released in order to allow the final remaining ice cubes to be dispensed through the door flap 28. Additionally, it is in this manner that the electronics 40 as described and depicted herein can provide that a power source 50 is disconnected from a solenoid 46 after the cradle 38 is released and after a delay period has expired.

While a preferred embodiment of the present invention is shown and described, it is envisioned that those skilled in the art may devise various modifications and equivalents without departing from the spirit and scope of the invention as defined by the appended claims. Of course, the invention is not intended to be limited by the foregoing disclosure. As an example, one of ordinary skill in the art would be able to design countless different circuits which would each achieve the same finction as the present invention.

The invention claimed is:

1. Electronics for disconnecting a power source from both a solenoid to move a structural body and from an electro-mechanical device, wherein said power source is powerably connectable to said solenoid and said electro mechanical device, wherein said solenoid is in operable connection with said structural body, said electronics comprising: a relay switch; a switch in operable connection with said relay switch, said relay switch communicatingly connected to said solenoid and connected to said power source, wherein said power source connects with and powers said electro-mechanical device when said switch is switched from a first position to a second position and said relay switch causes said power source to connect with and power said solenoid when said switch is switched from said first position to second position, wherein said solenoid causes said structural body to move when said switch is switched from said first position to said second position, and wherein said power source disconnects from said electro-mechanical device when said switch is returned to said first position and said relay switch disconnects said power source from said solenoid after said switch is returned to said first position.

2. The electronics as defined in claim 1, wherein said movable structural body is moveable between a first position and a second position, wherein said solenoid causes said structural body to move to said first position when said solenoid is connected with and powered by said power source, and wherein said solenoid causes said structural body to move to said second position after said solenoid is disconnected from said power source.

3. The electronics as defined in claim 2, wherein said solenoid causes said structural body to move to said second position after said power source is disconnected from said solenoid and after a delay time has expired.

4. The electronics as defined in claim 3, wherein said delay time is within a range of about four seconds to about ten seconds.

5. The electronics as defined in claim 3, wherein said delay time is less than four seconds.

6. The electronics as defined in claim 3, wherein said delay time is more than ten seconds.

7. The electronics as defined in claim 1, further comprising an electro-mechanical device connectable to said power source, wherein said power source powers said electro-mechanical device when said switch is switched to said second position.

8. The electronics as defined in claim 7, wherein said power source stops powering said electro-mechanical device after said switch is returned to said first position.

9. The electronics as defined in claim 1, wherein said relay switch is controlled by two transistors in a Darlington configuration.

10. The electronics as defined in claim 1, wherein said relay switch is not sensitive to electro-static discharge.

11. The electronics as defined in claim 9, wherein said transistors comprise NPN bipolar transistors.

12. The electronics as defined in claim 11, wherein said transistors are connected to a capacitor.

13. The electronics as defined in claim 12, wherein said capacitor is in parallel connection with a diode and said transistors, wherein said capacitor causes said transistors to be biased on while said capacitor is charged to a voltage greater than a voltage of said diode, and wherein said relay switch disconnects said power source from said solenoid when said capacitor de-charges to a voltage less than said voltage of said diode.

14. The electronics defined in claim 13, wherein said diode comprises a 24 volt zener diode.

15. The electronics as defined in claim 1, wherein said power source comprises a 120 Volt AC line.

16. An electronics device for controlling the dispensing of ice cubes through a door, said electronics device comprising:

an ice auger powerably connectable to a power source;

a solenoid in operative connection with the door and powerably connectable to said power source;

a relay switch connected to said solenoid and connected to said power source;

a switch in operable connection with said relay switch, wherein said power source connects to said ice auger when said switch is actuated, wherein said relay switch connects said power source to said solenoid when said switch is actuated causing said solenoid to cause the door to open, wherein said switch disconnects said power source from said ice auger when said switch is de-actuated, and wherein said relay switch disconnects said power source from said solenoid after the switch is de-actuated.

17. The electronics device as defined in claim 16, wherein said solenoid causes the door to close after said power source is disconnected from said solenoid.

18. The electronics device as defined in claim 17, wherein said solenoid causes the door to close after said power source is disconnected from said solenoid and after a delay time has expired.

19. The electronics device as defined in claim 18, wherein said delay time is within a range of about four seconds to about ten seconds.

20. The electronics device as defined in claim 18, wherein said delay time is less than four seconds.

21. The electronics device as defined in claim 18, wherein the delay time is more than ten seconds.

22. The electronics device as defined in claim 16, further comprising an electro-mechanical device connected to said power source, wherein said power source powers said electro-mechanical device after said switch is actuated to disense ice cubes through the door.

23. The electronics device as defined in claim 16, wherein said relay switch is controlled by transistors in a Darlington configuration.

24. The electronics device as defined in claim 16, wherein said relay switch is not sensitive to electro-static discharge.

25. The electronics device as defined in claim 23, wherein said transistors comprise NPN bipolar transistors.

26. The electronics device as defined in claim 25, wherein said transistors are connected to a capacitor.

27. The electronics device as defined in claim 26, wherein said capacitor is in parallel connection with a diode and said transistors, wherein said capacitor causes said transistors to be biased on while said capacitor is charged to a voltage greater than a voltage of said diode, and wherein said relay switch disconnects said power source from said solenoid when said capacitor de-charges to a voltage less than said voltage of said diode.

28. The electronics device as defined in claim 27, wherein said diode comprises a 24 volt zener diode.

29. The electronics device as defined in claim 16, wherein said power source comprises a 120 Volt AC line.

30. The electronics device as defined in claim 22, wherein said electro-mechanical device comprises an ice auger.

31. An electronics device for use with a refrigerator/freezer for controlling the dispensing of ice cubes by an ice auger through a door flap when a cradle is pressed, said electronics device comprising:

a solenoid in operative connection with the door flap and powerably connectable to a 120 Volt AC line power source, the ice auger being powerably connectable to the power source;

a relay switch controlled by two NPN bipolar transistors in a Darlington configuration which are in parallel connection with a diode and a capacitor, said relay switch connected to said solenoid and connectable to said power source the cradle being in operable connection with said relay switch, wherein the power source connects to the ice auger when the cradle is pressed, wherein said relay switch connects said power source to said solenoid when the cradle is pressed causing said solenoid to cause the door flap to open, wherein said power source powers the ice auger to dispense ice cubes through the door flap, wherein said capacitor causes said transistors to be biased on while said capacitor is charged to a voltage greater than a voltage of said diode, wherein the power source disconnects from the ice auger when the cradle is released, and wherein said relay switch disconnects said power source from said solenoid causing the door flap to close after the cradle is released and after said capacitor de-charges to a voltage less than said voltage of said diode.

32. A method for dispensing ice cubes through a door flap when a cradle is pressed, said method comprising:

a) when the cradle is pressed, connecting a power source to an electro-mechanical device to cause the electro-mechanical device to move the ice cubes toward the door flap, and closing a relay switch to close to connect the power source to a solenoid to open the door flap;

b) dispensing ice cubes through the door flap; and c) after the cradle is released, disconnecting the power source form the electro-mechanical device, and opening the relay switch to disconnect the power source from the solenoid.

* * * * *

UNITED STATES PATENT AND TRADEMARK OFFICE

CERTIFICATE OF CORRECTION

PATENT NO. : 5,886,430

DATED : March 23, 1999

INVENTOR(S) : James M. Ralson and Gregory Jay Ramsey

It is certified that error appears in the above-identified patent and that said Letters Patent is hereby corrected as shown below:

Column 7, Line 37 "disense" should be -- dispense --

Signed and Sealed this

Second Day of November, 1999

*Attest:*

Q. TODD DICKINSON

*Attesting Officer*

*Acting Commissioner of Patents and Trademarks*